United States Patent [19]

Knoll et al.

[11] 4,194,421

[45] Mar. 25, 1980

[54] SAFETY SYSTEM FOR THE DRIVE OF A SYNCHRONOUS CROSS CUTTER

[75] Inventors: Heiko Knoll; Wilfried Kurth, both of Duesseldorf, Fed. Rep. of Germany

[73] Assignee: Jagenberg Werke Aktiengesellschaft, Duesseldorf, Fed. Rep. of Germany

[21] Appl. No.: 923,870

[22] Filed: Jul. 12, 1978

[30] Foreign Application Priority Data

Aug. 31, 1977 [DE] Fed. Rep. of Germany ..... 2739191

[51] Int. Cl.[2] ..... B26D 5/00

[52] U.S. Cl. ..... 83/62.1; 83/62; 83/298; 83/313; 83/324

[58] Field of Search ..... 83/62.1, 62, 58, 298, 83/312, 313, 324

[56] References Cited

U.S. PATENT DOCUMENTS 3,982,454 9/1976 Schneider et al. ..... 83/324 X

*Primary Examiner*—J. M. Meister

*Attorney, Agent, or Firm*—Sprung, Felfe, Horn, Lynch & Kramer

[57] ABSTRACT

A safety system for the drive of a cross cutter for a web of material, having an electrical or mechanical synchronizing system between the drives of the feed and cutting mechanism which is adjustable for the size of the piece to be cut and which consists of an adjustable asymmetrical mechanism and has speed control associated with the drive of the feed mechanism to limit the speed of the feed means on the basis of a signal corresponding to the setting of the asymmetrical mechanism. A function generator generates a signal to be applied to the speed control which is directly dependent thereon to define the speed value for the drive of the feed mechanism and wherein the function generator is responsive to the asymmetrical mechanism for size-related, maximum permissible web velocity.

10 Claims, 1 Drawing Figure

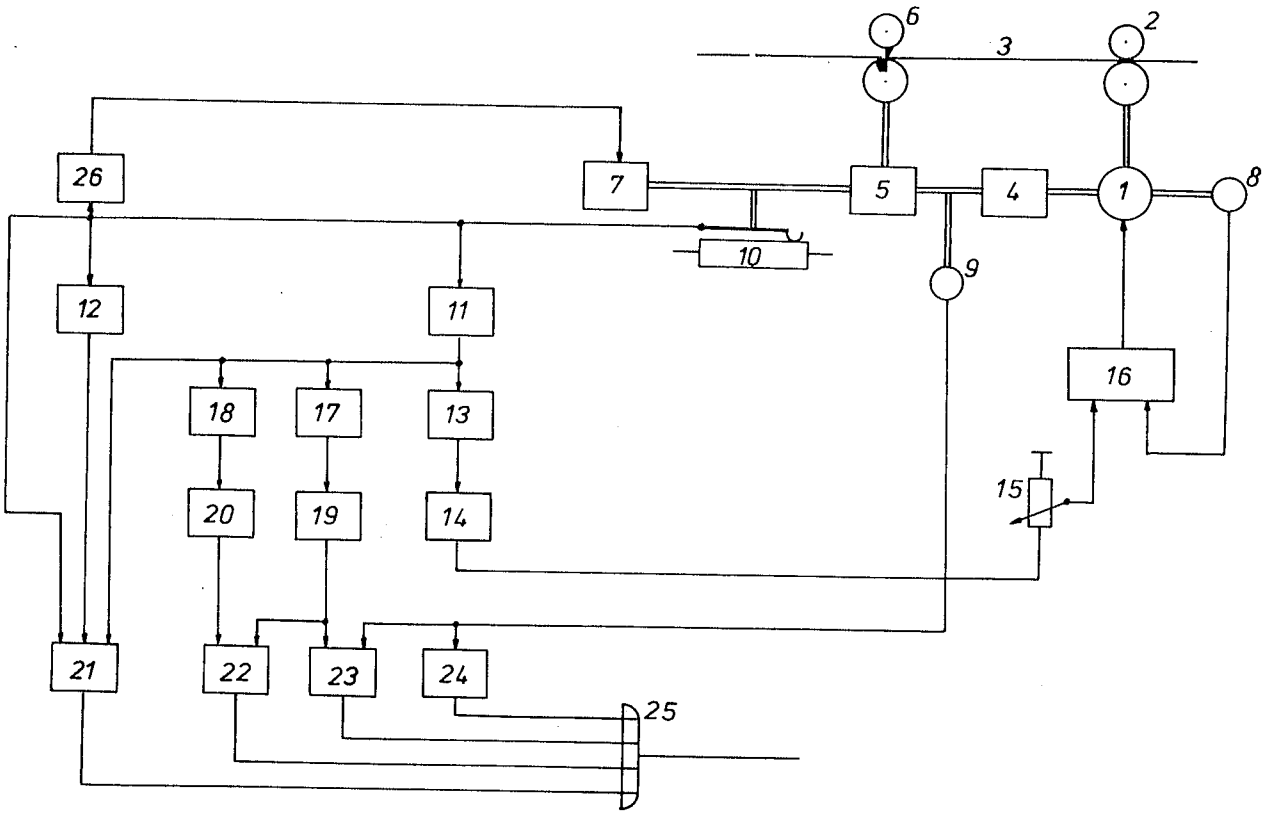
1
2
3
4
5
6
7
8
9
10
11
12
13
14
15
16
17
18
19
20
21
22
23
24
25
26

SAFETY SYSTEM FOR THE DRIVE OF A SYNCHRONOUS CROSS CUTTER

BACKGROUND

The invention concerns a safety system for the drive of a cross cutter for cutting a web of goods, having an electrical or mechanical synchronizing system between the drives of the feed means and the cutting means which can be adjusted to the size of the piece to be cut, consisting of an adjustable asymmetrical mechanism (coupler mechanism) associated with the drive of the cutting means, and having a speed regulator associated with the drive of the feed means which limits the speed of the feed means on the basis of a signal corresponding to the setting of the asymmetrical drive.

Synchronized cross cutters have the purpose of dividing a web of goods, for example paper, into single sheets, by means of shear cuts made transversely of the direction of movement of the web. In order for the shear cuts to be made cleanly, it is necessary that synchronism exist between the web of material and the knives of the cutting means consisting of two rotating cutter rolls. This synchronism is brought about at a web velocity determined by the feed means consisting of two rotating rolls by associating an asymmetrical mechanism in the form of a coupler mechanism. By means of such a coupler mechanism, a uniform rotatory movement is transformed to a periodically varying rotatory movement. Accordingly, in the case of sheets which are to be cut to a length that is greater than the circumference of the cutter rolls, the cutter rolls will lag behind the web of material outside of the cutting phase, while in the case of sheets which are to be cut shorter than the circumference of the cutter rolls they will lead it. The asymmetrical mechanism thus permits synchronism in the cutting phase independently, to a great extent, of the size of sheets to be cut. Such a synchronous cross cutter, however, cannot operate at the same maximum web velocity at each setting of the asymmetrical mechanism, because the greater the degree of asymmetry that is preset in the asymmetrical mechanism, the greater will be the acceleration and the greater, therefore, will be the stress on the asymmetrical mechanism.

A variety of safety systems are known for preventing the capacity of an asymmetrical mechanism from being exceeded. In a known safety system of this kind (DT-OS No. 2,554,894), when the asymmetrical mechanism is preset, a voltage is adjusted on a potentiometer which is varied by means of a function generator according to the relationship between the size to be cut and the asymmetrical setting. This varied value is compared with the web velocity in an integrating circuit. If in this comparison permissible limits are exceeded, a trouble signal is delivered to the speed regulator of the feed means, so that the web velocity is reduced or no further increase is permitted in the velocity. To improve the reliability of this safety system, an additional function generator having an integrating circuit is connected in parallel with the function generator and the integrating circuit. These two parallel circuits are monitored for errors by the fact that the two outputs of the integrating circuits put out a trouble signal through an AND gate.

Although such a safety system has two parallel control circuits, it does not satisfy the safety requirements. It is disadvantageous that in order to limit the velocity of the web of goods the output signal of the integrating circuit is delivered as a trouble signal to the speed regulator of the feed means. Thus the danger exists of "hunting" in the regulation system leading to cutting length errors. It is also disadvantageous that two parallel circuits are required for the improvement of reliability. Another important disadvantage is that the function generator or generators can be adjusted only after the cross cutter starts up, because they are to deliver trouble signals matched to the speed regulator of the feed means.

THE INVENTION

The invention has the object of creating a safety system for the drive of a synchronous cross cutter which will provide more reliable control than the known safety system, and which can be put into operation without complicated adjustments.

This object is achieved in accordance with the invention in a safety system of the kind mentioned above by the fact that the setting that can be made on the speed regulator is directly dependent upon the signal from a function generator operated by the asymmetrical mechanism for size-related, maximum permissible web velocities.

The safety system of the invention does not intervene in the regulator circuit, since it does not act upon the speed regulator by means of a trouble signal but directly affects its adjustable control parameter. For this reason, "hunting" cannot occur in the regulator resulting in cut length errors. Since the signal from the function generator which acts upon the control parameter does not have to be adapted to the speed regulator, the function generator can be programmed on the installed cross cutter before the safety system is put into operation. Complicated and time-consuming adjusting work is no longer necessary. Whereas in the known safety system, if a function generator fails, the prevention of overspeeding can be accomplished only by means of the function generator disposed parallel to the first function generator, this is achieved in the invention, in just one function generator, by the fact that in such a case the control parameter in the speed regulator will be equal to zero.

Preferably the asymmetrical mechanism operates a potentiometer from which the function generator obtains its input signal. The direct dependence of the control parameter on the function generator output signal can be brought about in a simple manner by causing the function generator to produce on an additional potentiometer a voltage from which the controlling parameter for the regulator can be derived.

In order to be able to adjust with the greatest possible accuracy the maximum permissible web velocity in relation to the cut size, provision is made for the function generator to consist of an analog-to-digital converter, a data store for the maximum web velocity in relation to size, and a digital-to-analog converter. In the data store it is then possible to program very accurately the function of the web velocity in relation to the size, which has a trapezoidal configuration.

To control the operation of the function generator and to adjust the synchronizer of the drives of the feed means and cutting means, a second function generator operated by the asymmetrical mechanism can be provided for size-related, maximum allowable speeds of the cutting means, whose output signal is fed together with a signal dependent upon the rotatory speed of the cutting means to a comparator which shuts off the drive of the cross cutter if the signals are not in agreement. The second function generator can consist of an analog-to-digital converter which is preferably the analog-to-digital converter of the first function generator, and of a data store for size-related, maximum permissible speed of the cutting means and a digital-to-analog converter. To check the operation of this second function generator, an identical function generator can be connected to the function generator, and its output signal is fed together with the output signal of the second function generator to a comparator circuit which will shut off the drive of the cross cutter if the signals are not the same.

In an additional embodiment of the invention in which reliability of operation is improved, a second identical analog-to-digital converter can be connected parallel to the analog-to-digital converter, and the output signals shut off the drive of the cross cutter if they do not agree.

As a check on the operation of the potentiometer that is operated by the asymmetrical mechanism, the potentiometer can be connected to a control system which will shut off the drive of the cross cutter in the event of failure of the signal supplied from the potentiometer, e.g., in the case of wire breakage.

As a check on the operation of a signal generator for the speed of the cutting means, the signal dependent on the speed of the cutting means is preferably fed to a control device which will shut off the drive of the cross cutter in case of failure of this signal.

With the safety system of the invention, a maximum of safety is achieved with a relatively simple apparatus.

Since it is only the parameter that controls the regulator associated with the feed means that is directly affected in relation to size, no intervention is performed on the regulator. In contradistinction to the known safety system, the function generator is not a part of the regulator circuit but only a unit for the control of the regulator. By controlling the regulator with a static signal, it is possible at this point to forestall hunting, which has hitherto resulted in cutting length errors and could be kept within the necessary tolerances only by complex optimation of the function generator to adapt it to the regulator. While in the known safety system the speed regulator is always at the preset maximum value, which causes the cross cutter to overspeed in the event of a failure of the trouble signal supplied by the function generator, in the safety system of the invention the cross cutter can speed up only to the maximum preset on the potentiometer in relation to the size being cut. Since the function generator in the safety system of the invention functions not as a part of the regulator but is a control means, a variety of regulator types can be used, provided they comply with the conventional nominal value standardization for the maximum speed. Since the function generator is digitally programmable, the cross cutter can always be operated up to the limit of its capacity for the particular size. Since the programming is performed before operation starts, the start-up is simpler and quicker to accomplish than the start-up of a cross cutter equipped with the safety system of the prior art.

BRIEF DESCRIPTION OF THE DRAWING

The invention is described below with the aid of the FIGURE which is a block diagram schematic representing an example of its embodiment.

DETAILED DESCRIPTION OF THE INVENTION

A direct-current motor 1 drives a web feed means 2 consisting of two revolving rolls. This web feed means determines the velocity of a web of material 3 which is delivered to a cutting means 6 consisting of two rotating cutter rolls. The cutting means 6 is coupled with the web feed means 2 through a synchronizing system which consists of a variable-ratio transmission (sizing mechanism) 4 and an asymmetrical drive (coupler drive) 5. The motor 1 also serves as the motor for driving the cutting means 6. An electrical synchronizing system can also be provided instead of the variable-ratio transmission 4. In such a case the cutting means 6 has its own drive motor. The rotatory speed of the two drive motors is brought into synchronism by a regulating means. A driving unit of this kind is, in itself, known in conjunction with a cross cutter having an automatic control system (DT-OS No. 1,554,817). A special adjustment is performed on the transmission 4 for each size that is to be cut. A corresponding adjustment is performed on the asymmetrical drive 5 by means of an adjusting mechanism 7. If the adjustments on drives 4 and 5 are correctly selected, the web of material 3 is cut into sheets of the desired length, the knives operating synchronously with the web of material 3 when the knives are in the cutting phase.

The adjustment of the asymmetrical drive 5 is transmitted mechanically to the wiper of a potentiometer 10. The wiper is connected to the input of an analog-to-digital converter 11 which feeds a 9-bit word corresponding to the value tapped by the wiper to a data store 13. The data store is programmed for the maximum permissible paper web velocity in relation to each sheet size. The programmed curve has a substantially trapezoidal shape. The data store 13 delivers an 8-bit word for the maximum permissible paper web velocity, corresponding to the preset sheet size, to a digital-to-analog converter 14, which applies a corresponding voltage to a potentiometer 15. The velocity at which the web is to be fed can be preset in the speed regulator 16 by means of the wiper of this potentiometer 15. The actual web velocity detected by a tachometer 8 is fed to the speed control 16 as an second parameter.

The safety system thus far described brings it about that, even when the wiper on potentiometer 15 is set at the maximum, the maximum allowable web velocity for the size selected will not be exceeded. If the signal delivered to the potentiometer 15 drops out on account of a disturbance of the function generator, the cross cutter will not overspeed, as in the known safety system, but will be stopped since the velocity called for is equal to zero. On account of the digital programming, the signal which determines the size-related maximum permissible paper web velocity can be adjusted very precisely, so that the cross cutter can be operated in an optimum manner for each size, i.e., at the limit of its capacity.

The signal delivered by the analog-to-digital converter 11 is fed to two additional, parallelly disposed data stores 17 and 18 and to the digital-to-analog converters 19 and 20 connected to their output. The data stores 17 and 18 are programmed for the maximum permissible speed of the cutting means 6 with respect to the particular size of sheet. The size-related speed function for the cutting means 6 corresponds to a substantially triangular curve. Like the data store 13, the two data stores 17 and 18 receive as their input signal a 9-bit word, and supply an 8-bit word as their output signal. The output signal delivered by the data store 17 through the digital-to-analog converter 19 is fed to a comparator 23 which receives as the signal for comparison the signal corresponding to the speed of the cutting means 6, which is supplied by a tachometer 9. The tachometer 9 is engaged between the transmission 4 and the asymmetrical drive 5, so that it signals the cutting means speed before the uniform rotatory movement is transformed to the periodically varying rotatory movement. If the drives 4 and 5 are correctly set and the data storage 13 and the digital-to-analog converter 14 are operating correctly, the comparator 23 will deliver no output signal. If, however, a disturbance occurs and the input signals no longer agree, it delivers through an OR gate 25 a signal which shuts off the drive of the cross cutter. In this comparison of the input signals, it is still possible to distinguish whether or not the speed signal delivered by the tachometer 9 is below the maximum allowable speed signal. As long as it is lower than the maximum permissible speed signal, no signal needs to be given for the shut-off. The data store 17 with the digital-to-analog converter 19 and the data store 18 with the analog-to-digital converter 20 check on one another. Since they receive the same input signals and have the same structure and are programmed the same, they must deliver the same signals to a comparator 22 if they are operating properly. If the signals do not agree, a signal is given through the OR gate 25 to shut off the drive of the cross cutter.

The signal fed to the analog-to-digital converter 11 is supplied to an additional analog-to-digital converter 12. The outputs of both analog-to-digital converters are connected to the inputs of a comparator circuit 21. The analog-to-digital converters 11 and 12 thus control one another. If the output signals of the two analog-to-digital converters 11 and 12 differ, the comparator 21 will deliver through the OR gate 25 a signal TO SHUT off the drive 1 of the cross cutter.

To check on the operation of potentiometer 10, the wiper is connected to the comparator 21. If the comparator 21 receives no signal from the potentiometer 10, as the result of a broken wire, for example, the comparator 21 will also deliver through the OR gate 25 a signal to shut down the drive 1.

To check the operation of the tachometer 9, an additional detector means 24 is provided which, for example in the case of the failure (wire breakage) of the tachometer 9, will deliver through the OR gate 25 a signal to shut down the drive 1.

The wiper of the potentiometer 10 is furthermore connected to an electronic limiting means 26 for the adjusting mechanism 7.

It will be appreciated that the instant specification and claims are set forth by way of example and not limitation, and that changes and modifications may be made thereto without departing from the spirit and scope of the present invention.

What is claimed is:

1. In a safety system for the drive of a cross cutter for a web of material, having an electrical or mechanical synchronizing system between the drives of the feed means and cutting means which is adjustable for the size of the piece to be cut and which consists of an adjustable asymmetrical mechanism and has speed control means associated with the drive of the feed means to limit the speed of the feed means on the basis of a signal corresponding to the setting of the asymmetrical mechanism, wherein the improvement comprises function generator means for generating a signal to be applied to the speed control means which is directly dependent thereon to define the speed value for the drive of the feed means and wherein the function generator means is responsive to the asymmetrical mechanism for size-related, maximum permissible web velocity.

2. The safety system according to claim 1, further comprising a potentiometer operated by the asymmetrical mechanism and from which the function generator means obtains its input signal.

3. The safety system according to claim 2, further comprising a second potentiometer receptive of a voltage from the function generator means and from which the prescribed setting of the speed control can be derived.

4. The safety system according to claim 1, wherein the function generator means comprises an analog-to-digital converter, a data store for size-related, maximum permissible web velocity, and a digital-to-analog converter.

5. The safety system according to claim 4, further comprising second function generator means operated by the asymmetrical mechanism for size-related, maximum permissible speed of the cutting means and a first comparator receptive of the output signal of the second function generator means together with a signal dependent upon the speed of the cutting means to develop an output signal for effecting the shutting off of the drive of the cross cutter if the signals are not in agreement.

6. The safety system according to claim 5, wherein the second function generator means comprises said analog-to-digital converter, a second data store for size-related, maximum permissible speed of the cutting means, and a digital-to-analog converter.

7. The safety system according to claim 6, further comprising third function generator means connected in parallel to the second function generator means, and a second comparator receptive of the output signals from the second and third function generator means to develop a signal for effecting the shutting off of the cross cutter drive if the signals are not in agreement.

8. The safety system according to claim 4, further comprising a second analog-to-digital converter connected in parallel to the first mentioned analog-to-digital converter, and a third comparator receptive of the output signals of both analog-to-digital converters to effect the shutting off of the cross cutter drive in the event of discrepancy.

9. The safety system according to claim 5, further comprising control means receptive of the output of the second function generator means for effecting the shutting off of the cross cutter drive in the event of failure of this signal.

10. The safety system according to claim 2, further comprising control means connected to the potentiometer for effecting the shutting off of the cross cutter drive in the event of the failure of the signal supplied by the potentiometer.

* * * * *